US006025566A

United States Patent [19]

Chauvet et al.

[11] Patent Number: 6,025,566

[45] Date of Patent: Feb. 15, 2000

[54] SIGNALING DEVICE WITH LIGHT EMITTING DIODE

[75] Inventors: Francis Chauvet, Moutiers; Philippe Raffoux, Champniers, both of France

[73] Assignee: Schneider Electric SA, Boulogne Billancourt, France

[21] Appl. No.: 09/050,966

[22] Filed: Mar. 31, 1998

[30] Foreign Application Priority Data

Apr. 4, 1997 [FR] France ..... 97 04251

[51] Int. Cl.[7] ..... H01H 9/18

[52] U.S. Cl. ..... 200/314

[58] Field of Search ..... 200/314, 313, 200/316

[56] References Cited

U.S. PATENT DOCUMENTS 3,755,661 8/1973 Bouvrande ..... 200/314 X

FOREIGN PATENT DOCUMENTS 2 652 433 3/1991 France .
92 00 772 4/1992 Germany .
WO 86/06872 11/1986 WIPO .

*Primary Examiner*—Renee S. Luebke
*Attorney, Agent, or Firm*—Oblon, Spivak, McClelland, Maier & Neustadt, P.C.

[57] ABSTRACT

A signaling device with light emitting diode placed on a printed circuit that is housed in a body, which may for example be tubular. The light emitting diode 21 is surface mounted on one side 20*a* of the printed circuit 20 and its emission beam is directed along a direction Y–Y' perpendicular to the axis of symmetry X–X' of the body 13, and the body has a tubular part fitted with an unpolished flared surface 17 inside and facing the diode.

6 Claims, 1 Drawing Sheet

SIGNALING DEVICE WITH LIGHT EMITTING DIODE

BACKGROUND OF THE INVENTION

1. Field of the Invention

This invention relates to a signaling device such as an indicating light or a light push button comprising a body with a longitudinal axis and terminated by a head that has a translucent device from which a useful light beam is output, and a printed circuit on which there is a light emitting diode that generates an emitting beam producing the useful beam.

1. Discussion of the Background

It is known how to make indicating lights equipped with a light emitting diode mounted on a printed circuit that are also equipped with various components specific to a diode power supply circuit; the light emitting diode is usually placed at the end of the printed circuit on its edge, such that the diode emission beam is directed along an axis parallel to the plane of the printed circuit. However, this assembly mode is not suitable if a diode designed for surface mounting is used (SMC) . It is also known how to install an SMC light emitting diode on a printed circuit with its emitting surface directed such that the emitted beam remains parallel to the plane of the circuit. It is normally considered a disadvantage to place the light emitting diode differently, since the energy of the resulting useful beam is then reduced.

Furthermore, it is difficult to use a common layout for indicating lights and for light push buttons. It is observed that since the light diffusion surface on the push buttons is essentially mobile, an annoying brightness variation occurs between adjacent signaling devices such as indicating lights and light push buttons and the appearance of these devices cannot be made similar.

SUMMARY OF THE INVENTION

The purpose of this invention is to structure a signaling device such as indicating light or a light push button such that the useful light signal obtained with this device is extremely homogeneous and in particular several such devices can be placed close to each other without any difference in appearance.

The light emitting diode according to the invention is surface mounted on one side of the printed circuit such that its emission beam is directed along a direction approximately perpendicular to the longitudinal axis of the body and the general shape of the body is tubular, and has an unpolished flared reflection surface inside facing the lateral diode.

The resulting light diffusion is very homogeneous and in particular is very similar on an indicating light or on a light push button equipped with the same device, while avoiding the concentration of light flux at a point at the center of the translucent device that diffuses light.

Preferably, the light emitting diode is installed near the end of the printed circuit facing the unpolished flared surface such that the part of the printed circuit between the end of the board and the diode does not affect the transmitted flux.

BRIEF DESCRIPTION OF THE DRAWINGS

The following description of an embodiment of the invention is given as an example, with reference to the attached drawings.

DESCRIPTION OF THE PREFERRED EMBODIMENT

Figure 1:
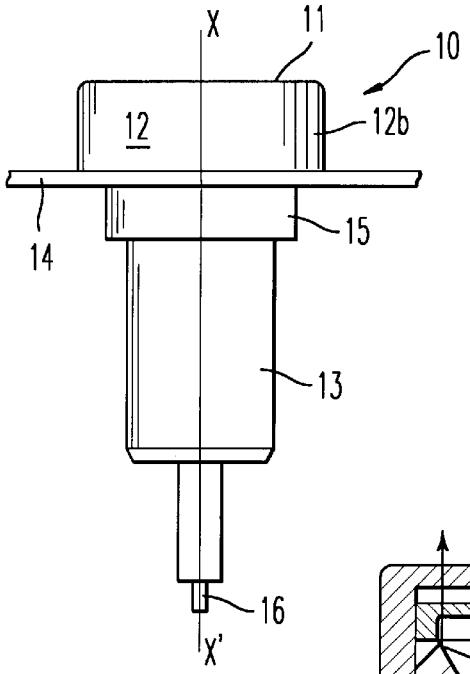
FIG. 1 shows an elevation of a light emitting diode indicating light according to the invention.

The signaling device shown in the figures is an indicating light 10 that comprises a head 11 fitted with a translucent device 12 that diffuses light and a body 13 made of opaque plastic material with a generally tubular shape and a longitudinal axis X–X'; the translucent device 12 comprises a translucent wall 12*a* diffusing light and a colored cap 12*b* that covers the wall 12*a* and is transparent or translucent. The shape of the body 13 is cylindrical but it may also have a parallelepiped shape.

The head 11 is designed to be visible above an indicating light assembly surface 14 whereas the body 13 is used firstly to attach the indicating light and secondly to contain diode connections and power supply means; the body 13 is inserted in an orifice in wall 14 and is fixed adjacent to it, for example by means of a threaded part 13*a* onto which a nut 15 can be screwed. Connection and power supply means include external connection elements 16, for example screw or elastic pins or terminals and a power supply circuit, the components of which are supported on a printed circuit 20.

The light emitting diode 21 according to the invention is a surface mounted component (SMC) on the printed circuit 20 on the same side 20*a* of this circuit as the components 22 of its power supply. The light emitting diode 21 is located in the immediate vicinity of the upper edge 20*b* of the printed circuit 20, at the same level as the flared surface 17 of the body, at a height h from the initial directrix 17*a* of this surface opposite to the translucent diffusing device 12.

The printed circuit 20 may be aligned with the longitudinal axis of symmetry X–X' of the indicating light or may be slightly offset, and the lateral light emitting diode 21 emits a beam F1 along an average axis Y–Y' approximately perpendicular to the X–X' axis; the height h of the diode and its average emission axis Y–Y' with respect to the directrix 17*a* is determined to enable a good reflection of beam F1 towards the front of the indicating light by multiple reflections on surface 17.

Surface 17 of body 13, or of a reflecting part added onto body 13, facing diode 21 is not polished, or is possibly dulled, in order to create a Lambertian surface condition, in other words favorable to reflections of beam F1.

Figure 2:
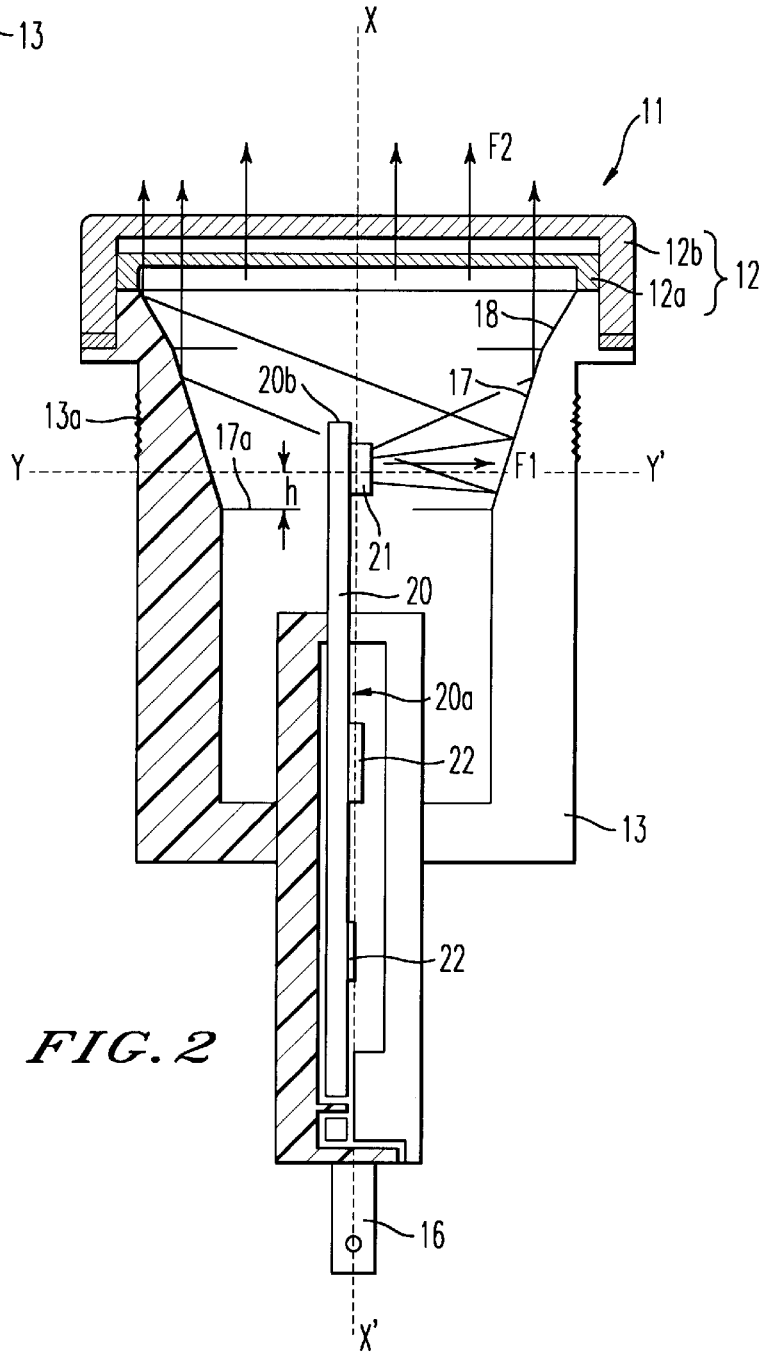
FIG. 2 shows an enlarged axial sectional view of the indicating light in FIG. 1.

As shown in FIG. 2, multiple reflections are applied to beam F1, initially on the flared surface 17 with a very low loss through the side wall of body 13, then secondly on part of the surface 18 that is connected to the flared surface 17 and which is more flared, to exit from the indicating light through device 12, in other words with diffusion through the translucent diffusion surface 12*a* and then transmission through the rear surface of cap 12*b* in the form of a useful beam F2. The diffuser and/or the cap is colored appropriately to the wave length emitted by the diode.

The invention is also applicable to signaling devices in which the translucent device or the cap is mobile along the longitudinal X–X' direction of the body. It is found that with the signaling devices described, there is no light point at the center of the cap and the lighting produced by indicating lights is very similar to the lighting produced by push buttons according to the invention when they are placed adjacent to each other or close to each other.

What is claimed is:

1. A signaling device comprising:

a body with a longitudinal axis and terminated by a head that comprises a translucent diffusion device from which a useful light beam is emitted, and a printed circuit supporting a light emitting diode that generates an emission beam producing the useful beam, characterized in that:

the light emitting diode is surface mounted on one side of the printed circuit such that a direction of its emission beam is approximately perpendicular to the longitudinal axis of the body, and one part of the body has a generally tubular shape with an unpolished flared inside surface, facing the diode, wherein said printed circuit is disposed in said generally tubular part of the body aligned with said axis.

2. A signaling device according to claim 1, characterized in that the light emitting diode is mounted on the printed circuit immediately adjacent to an end of the printed circuit located in the tubular part of the body at substantially a same level as its unpolished flared surface.

3. A signaling device according to claim 1, characterized in that the body has an unpolished surface connected to the unpolished flared surface, more flared that the flared surface and located between the flared surface and the translucent diffusing device generating the useful beam.

4. A signaling device according to claim 3, wherein said unpolished inside flared surface approximates a Lambert surface.

5. A signaling device according to claim 4, wherein said unpolished surface approximates a Lambert surface.

6. A signaling device according to claim 1, wherein said unpolished inside flared surface approximates a Lambert surface.

* * * * *